United States Patent [19]

Mitchell et al.

[11] Patent Number: 4,825,509

[45] Date of Patent: May 2, 1989

[54] REINFORCEMENT HINGE REPAIR KIT

[76] Inventors: Mark D. Mitchell, 243 Londonderry La., Getzville, N.Y. 14068; Olin Jones, 218 Stevens Ave., Buffalo, N.Y. 14215

[21] Appl. No.: 280,873

[22] Filed: Dec. 7, 1988

[51] Int. Cl.[4] ..... E05D 5/02

[52] U.S. Cl. ..... 16/382; 16/254; 16/DIG. 40; 16/DIG. 43; 49/501

[58] Field of Search ..... 16/242, 247, 248, 254, 16/382, DIG. 40, DIG. 43; 49/501, 506

[56] References Cited

U.S. PATENT DOCUMENTS

| | | | |
|---|---|---|---|
| 4,118,827 | 10/1978 | Yamamoto | 49/501 X |
| 4,304,027 | 12/1981 | DiFazio | 16/382 X |
| 4,438,597 | 3/1984 | Maggart | 16/242 X |
| 4,553,286 | 11/1985 | Schwarz, II | 16/382 |

*Primary Examiner*—Fred A. Silverberg
*Attorney, Agent, or Firm*—James J. Ralabate

[57] ABSTRACT

This invention relates to a kit for reinforcing door hinges and, more specifically, to a two-piece kit for strengthening door hinges that may have come loose. The kit comprises a two-piece hinge repair kit that is adapted for use with standard size doors and with standard size hinges. The first piece of the kit is a rectangular U-shaped bracket having an open side or face. This U-shaped bracket is adapted to fit through its open side around the edge of the door. The sides and roof of this U-shaped structure have apertures to be used as connecting holes for attachment to the door and hinge. The roof has a recessed cutout section containing the holes for alignment with the holes of a hinge. The cutout distance down from the top of the roof should approximate the thickness of one leaf of the hinge. Thus, when the hinge is attached to the U-shaped bracket and door, the top surface is level with the face of the bracket and flush with the face of the roof sides adjacent the cutout portion. The vertical sides of the U-shaped bracket extending down from the roof portion contain screw holes for attaching the U-shaped bracket to the side edge portion of a door. This U-shaped mounting bracket is merely slipped over the door with some of its roof apertures aligned with the existing screw holes so that no adjustment or further chipping away of the door edge is required.

6 Claims, 2 Drawing Sheets

REINFORCEMENT HINGE REPAIR KIT

This invention relates to a kit for reinforcing door hinges and, more specifically, to a two-piece kit for strengthening door hinges that may have come loose.

BACKGROUND OF THE INVENTION

There are known various structures for securing hinges to doors and door frames of both wood and metal. In wooden doors in particular, it is not uncommon for the hinge to become loose after prolonged use. The screws used to hold the hinge in place are generally pulled free of the door or door jamb leaving larger holes than originally created by the screws. Therefore, to reattach the hinge, the door or door jamb needs to be repaired in order to reattach the hinge. In some instances, the hinge cannot be located in its original position because of damage to the door and jamb. In these cases the hinge is relocated and attached to a new portion on the door. The door needs to be cut out in the new location in order to accommodate the thickness of the hinge to be located thereon.

Several hinge reinforcement devices have been patented but none of them provide the utility offered by the present invention. In U.S. Pat. No. 4,304,027 (DiFazio) a horizontally-adjustable door hinge is disclosed. DiFazio suggests using a hinge structure having a back plate 30 which is used as a backup plate to elongated plate 25. This combination of plates fits along the vertical edge of the door frame to facilitate the horizontal adjustment of the door. The hinge is then attached to these plates to adjust the alignment. The problem approached by DiFazio is to correct doorways that are out of plumb, that is, the jambs, header and sill sections of the frame may be out of square alignment. This condition is caused by structures that are misaligned because of settling or shifting of the basic structure. DiFazio's structure cannot be used as a repair kit because the thickness of his combined structure would render the door non-functional unless it was out of horizontal alignment.

In U.S. Pat. No. 4,438,597 (Maggart) an adjustable hinge mount is disclosed for use on metal doors and door frames. The door frame 20 is part of the door body which has a cutout portion 62. A reinforcing plate or flat bracket member 90 is inserted inside the door covering the opening 62. Bracket 90 is then attached to the inside of the door and a hinge 40 is then attached to the bracket 90. Again, Maggart's device is used primarily to correct the alignment of a pre-hung door. Also, Maggart can only be used on metal doors since a hollow door is required for use of internally-secured bracket 90. To use the Maggart device one would cut a hole in the metal door or door jamb in order to slip the bracket 90 inside the door for adjustment. This procedure is relatively complex especially for the non-professional who is not accustomed to metal work and metal cutting.

In U.S. Pat. No. 4,553,286 (Schwarz, II) a hinge preparation assembly for a steel door frame is disclosed. The hinge cutouts or mortises in a frame or door are covered over by the Schwarz assembly. There are interior plates that are first attached to the interior of the door covering the mortises. The hinge is then connected onto these plates. The hinge preparation assembly includes a hinge reinforcement member with a plurality of spaced apart threaded openings for mounting a leaf of a standard hinge set. The hinge reinforcement is converted from a standard weight hinge preparation to a heavyweight hinge preparation. Again, usage of the Schwarz assembly is somewhat complicated for the non-professional and requires knowledge of metal-working to be effective. It is not the type of assembly that can easily be used by the do-it-yourselfer. Also, it cannot be used on wooden doors to reinforce loose hinges or make existing hinges more secure.

SUMMARY OF THIS INVENTION

It is therefore an object of the present invention to provide a hinge reinforcement kit devoid of the above-noted disadvantages.

Another object of this invention is to provide a repair kit easy to use and relatively inexpensive.

A further object of this invention is to provide a reinforcement hinge repair kit that can be used on both wooden and metal doors.

Another further object of this invention is to provide a reinforcement hinge repair kit that is very effective in securely fixing loosened hinges to doors and door frames.

Still a further object of this invention is to provide a two-piece kit that is a universal product that is adapted for use with substantially any size standard hinge.

Yet still a further object of this invention is to provide a strong hinge kit that will strengthen cracked or damaged hinge areas on doors and door frames.

Another still further object of this invention is to provide a repair kit that is adapted to replace stripped screw holes in the door or frame and permit the secure attachment of a hinge thereto.

These and other objects of this invention are provided, generally speaking, by a two-piece hinge repair kit that is adapted for use with standard size doors and with standard size hinges. When a door hinge becomes loose because of prolonged usage or settling or warping or any other reason, repair of the door or frame becomes a problem. The kit of this invention is designed to be used over these damaged areas and, in most cases, provides a hinge anchor more secure and stronger than the original. The first piece of the kit is a rectangular U-shaped unit having an open side or face. This U-shaped structure is adapted to fit through its open side around the edge of the door. The sides and roof of this U-shaped structure have apertures to be used as connecting holes for attachment to the door and hinge. The holes on the roof are positioned so as to accommodate and align with the holes of standard size hinges. The roof of this first mounting bracket has a recessed cutout section containing the holes for alignment with the holes of a hinge. The cutout distance down from the top of the roof section should approximate the thickness of one leaf of the hinge. Thus, when the hinge is attached to the U-shaped bracket and door, the top surface is level with the face of the bracket flush with the face of the roof sides adjacent the cutout portion. The vertical sides of the U-shaped bracket (or saddle) extending down from the roof portion contains screw holes for attaching the U-shaped bracket to the side edge portion of a door. This U-shaped mounting bracket is easy to use. It is merely slipped over the door with some of its roof apertures aligned with the existing screw holes so that no adjustment or further chipping away of the door edge is required. This bracket is designed to replace the stripped screw holes in the wood (or metal) to reinforce and support the weight of the door. Therefore, the U-shaped mounting bracket does not require adjustment, is strong, universally fitted and can use existing screw holes for alignment with roof holes and hinge holes. The second mounting bracket fits against a door frame or door jamb and fits in the exact location of the previously located hinge leaf. The holes in this second mounting bracket are also located to universally accommodate all standard type hinges. The holes in standard 3, 3½ and 4 inch hinges are about ⅛-½ inches apart and positioned one in the center and one hole in each of the end portions of the hinge leaf as shown in FIG. 5. This door jamb mounting bracket is in the form of a thin bar or metal strip with holes therein for attachment with screws to the door frame and appropriate hinge leaf. This metal strip is thin enough so that it can fit over the location of the damaged holes in the door frame without hindering the function of the hinge or closing of the door. The first and second mounting brackets are constructed of a strong material such as steel, aluminum, plastic, fiberglass or other appropriate materials. Obviously, steel is the preferred material because of its strength and durability. While usage of these brackets is universal, it is preferred that they be used on wooden doors and wooden door jambs or frames. These two mounting brackets are designed to make repair on wooden doors easy and effective. The repaired location on the door or frame is stronger than originally because of the steel or metal brackets used. Ordinarily a person would have to chisel out of the door and door jamb a location to relocate the hinge leaves. With the present invention the person merely locates the brackets over the old hinge locations and fixes the brackets to that location. The hinge then is attached to each bracket. The brackets are positioned so that some of the holes in each are aligned with the old stripped holes of the previous hinge location.

DESCRIPTION OF THE DRAWING AND PREFERRED EMBODIMENT

Figure 1:
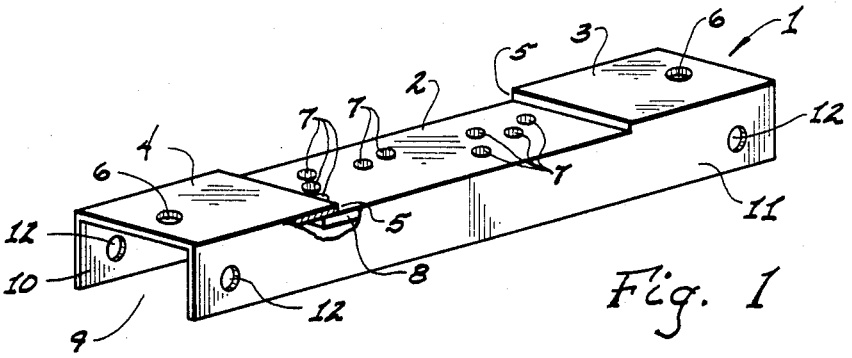
FIG. 1 is a perspective view of the U-shaped mounting bracket of this invention for use on a door edge.
Figure 2:
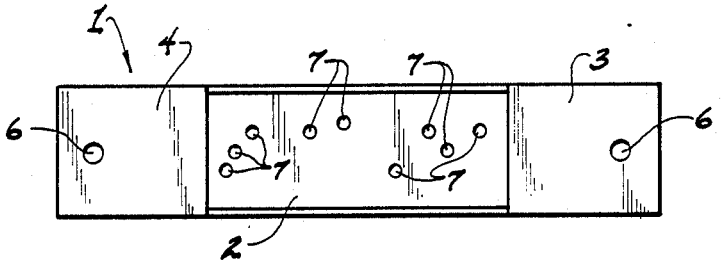
FIG. 2 is a top plan view of the U-shaped mounting bracket of this invention.
Figure 3:
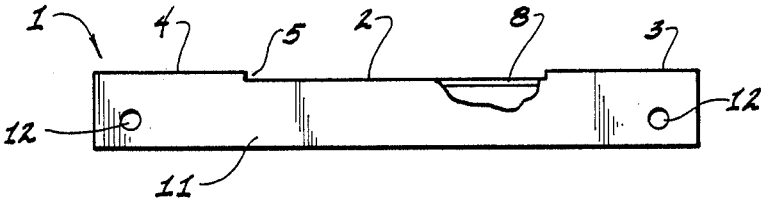
FIG. 3 is a side plan view of the U-shaped mounting bracket of this invention.
Figure 4:
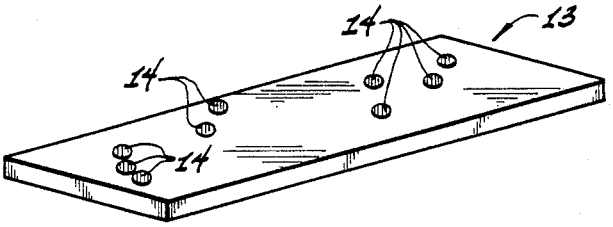
FIG. 4 is a perspective view of the bar-shaped mounting bracket of this invention for use on a door frame.
Figure 5:
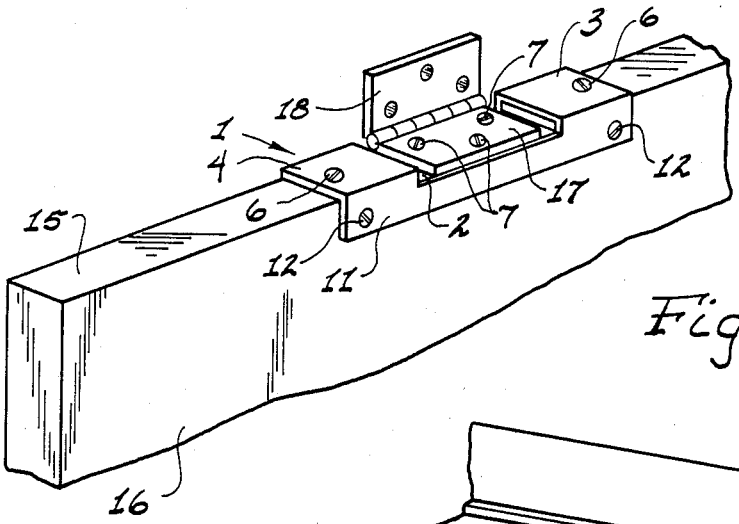
FIG. 5 is a perspective view of the elongated U-shaped bracket attached to a door and a hinge.
Figure 6:
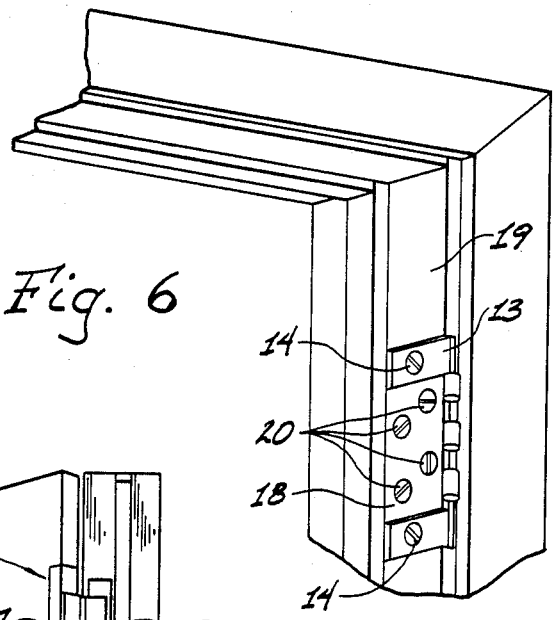
FIG. 6 is a perspective view of the bar-shaped mounting bracket attached to a door frame and a hinge leaf.
Figure 7:
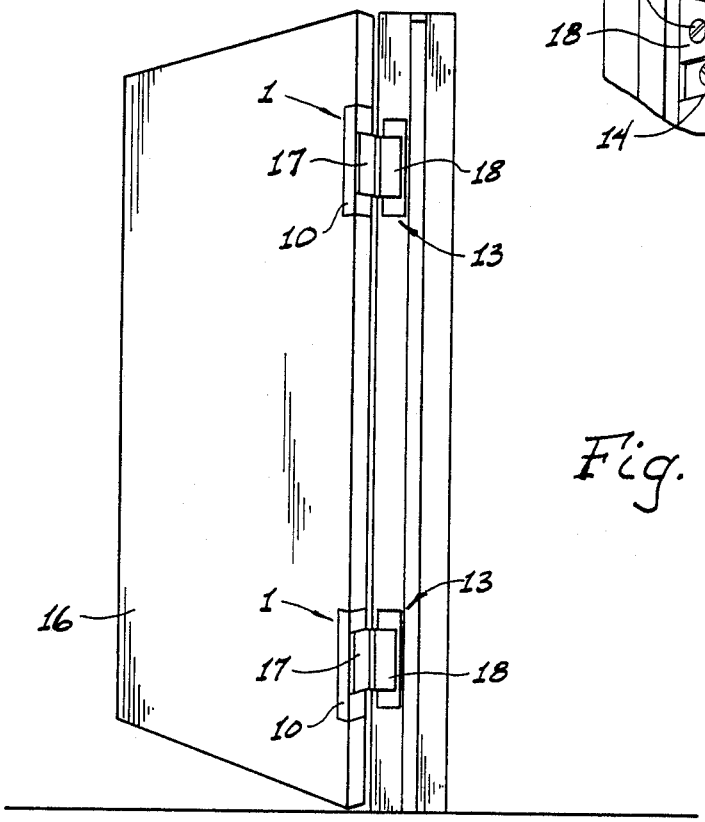
FIG. 7 is a perspective view of both brackets in place with hinge attachments on a door and frame.

In FIG. 1 the elongated U-shaped mounting bracket 1, the first piece of the two-piece repair kit is illustrated. Mounting bracket or saddle 1 has a front view U-shaped configuration and has an open face so that it can be easily slipped over the edge portion of a door in the area where the hinge is generally located. Bracket 1 is elongated and has a three-sectioned roof, the center depressed section 2 being cut away and recessed or depressed below the level of roof side sections 3 and 4. The distance 5 of the depressed section down from the upper plane of side sections 3 and 4 should approximate the thickness of a hinge leaf so that upon installation the hinge upper face will be flush with the upper surfaces of side sections 3 and 4. This feature where distance 5 is about the same as the thickness of the specific hinge to be used is critical to this invention. The thickness of a standard hinge is about 1/16 to ⅛ inch. Side roof sections 3 and 4 have apertures 6 therein and therethrough by which th bracket 1 is attached to the door. Also, in center depressed portion 2 are located holes 7 which can be universally aligned with the holes in most size hinges. The thickness 8 of center section 2 should be approximately equal to the thickness of other portions of the bracket 1. U-shaped bracket 1 is elongated and has an open face or side 9 which snuggly fits around the edge section of a door. By "elongated" is meant the elongated or extended structure and configuration shown in FIGS. 1, 2 and 3. Vertical sides 10 and 11 of bracket 1 extend downward from roof sections 2, 3 and 4 and complete the U-shaped configuration of bracket 1. Side portions 10 and 11 have apertures 12 therein to receive screws for attachment to the sides of the door edge. The thickness of U-shaped mounting bracket 1 is small so that it will not impede the closing of a door. FIGS. 1 and 5 exaggerate this thickness for illustrative purposes. FIG. 2 shows a top view of the U-shaped mounting bracket 1 of FIG. 1. Apertures 6 are used to screw bracket 1 to the front of the door edge and apertures 12 as shown in FIG. 1 are used to screw the bracket to the side of the door edge at a location where the hinge was originally positioned. The apertures 7 are arranged in center depressed section 2 in such a manner that they will always align with the holes in standard hinges of different sizes. The width 9 of the opening of elongated bracket 1 is slightly greater than that of a standard door so that it can easily be fitted over and around the door edge when in use. In FIG. 3 elongated bracket 1 is shown from a side view where the critical feature of a depressed center section 2 is clearly illustrated. The height or depression distance 5 is equal to the standard thickness of a hinge to be used so that when the hinge is attached to section 2 in bracket 1, the upper face of the hinge will be on the same plane as the upper surfaces of end sections 3 and 4. If section 2 was not depressed at the same distance as the dimension of the thickness of a standard hinge it would interfere with the proper closing of the door. Apertures 12 are used to accommodate a screw for attachment of elongated U-shaped bracket to the door edge sides. Elongated U-shaped bracket 1 has a roof section 2, 3, 4 and sides 10 and 11 at right angles thereto to conform to the shape of a door's edge cross section. In FIG. 4 the door frame bar-shaped mounting bracket 13 is shown. Mounting bracket 13 is in the form of a thin bar or metal sheet having apertures 14 that will align with the standard hole patterns of 3-inch, 3½-inch and 4-inch hinges. Obviously, the apertures 14 and 7 of U-shaped bracket in FIG. 1 can be positioned to accommodate other size hinges if desired. The unused apertures 14 that are not in alignment with the holes in a hinge can be then used to attach mounting bracket 13 to the door frame as shown in FIG. 6. The thickness of mounting bracket 13 is small so that it will not impede the closing of a door. In FIG. 5, U-shaped mounting bracket 1 is shown as it is attached to door edge 15. The end edge surface 15 of the door is adjacent the inside surface of roof 2, 3, 4 and screws are tightened through apertures 6 (as in FIGS. 1 and 2) to connect bracket 1 to door edge 15. The sides 10 and 11 of bracket 1 fit around door edge 15 and are connected to door sides 16 by screws extended through apertures 12. The upper surface 17 of hinge leaf after attachment is substantially on the same plane as the upper surfaces of end sections 3 and 4 of bracket 1. This is provided for by making the depressed distance of surface 2 from surfaces 3 and 4, (shown as 5) approximately equal to the thickness of hinge leaf 17. Hinge leaf 18 is then attached to door frame mounting bracket 13 as shown in FIG. 6. Bracket 1 fits over the damaged holes originally used in door edge 15 and the holes 7 in bracket 1 are now used to attach hinge leaf 17 to the door. The rigid structure of brackets 1 and 13 reinforce and strengthen the locations of the originally positioned hinges. In FIG. 6 bracket 13 is attached to door frame 19 by putting screws through top and bottom apertures 14. The remaining apertures 14 are aligned with hinge holes 20 and used to screw attach hinge leaf 18 to the door frame 19. The bracket 13 fits over the damaged holes originally in door frame 19 and reinforces the hinge location thereby holding the hinge leaf 18 securely to door frame 19. In FIG. 7 the completely installed kit including brackets 1 and 13 are shown on the door with hinge 17 and 18 attached thereto. The sides 10 or 11 of bracket 1 are visible over door sides 16 but may be painted the same color as door sides 16 so as to blend in and be barely visible.

The preferred and optimumly preferred embodiments of the present invention have been described herein and shown in the accompanying drawing to illustrate the underlying principles of the invention but it is to be understood that numerous modifications and ramifications may be made without departing from the spirit and scope of this invention.

What is claimed is:

1. A reinforcement hinge repair kit comprising only two one piece brackets, a first and second bracket, the first one piece bracket being an elongated U-shaped structure with a roof portion and two side sections extending down from and disposed at substantially right angles to said roof portion to form an open face, said roof portion having three sections, a center section and two end sections, said center section depressed downward from surfaces of said end sections, the distance from the plane of said center section to the plane of said end section being substantially the same as the thickness of a standard hinge leaf wherein when the hinge leaf is attached to the first bracket the top surface of the hinge leaf is level with the roof portion end sections to thereby prevent impedement of the closing of the door and the function of a hinge, said center section having apertures therein which will align with standard hinge leaf holes when in use, said end sections having apertures therein for receiving screws for attachment of said first bracket to a door edge, said second one piece bracket having a bar-like configuration with apertures therethrough to accommodate attachment of said second bracket to a door frame and also to accommodate attachment to a hinge leaf, said first hinge bracket being slipped over the door edge to repair and strength the door edge and to permit the hinge to be secured to a damaged or cracked door edge.

2. The kit of claim 1 wherein the apertures in said second bracket being positioned so as to align with holes in a standard hinge.

3. The kit of claim 1 wherein said first U-shaped bracket has apertures in said side sections.

4. The kit of claim 1 wherein said brackets are constructed of steel.

5. The kit of claim 1 wherein said brackets are constructed from a material selected from the group consisting of metal, plastics, wood, fiberglass or mixtures thereof.

6. The kit of claim 1, wherein said depressed center portion apertures being at least three apertures therein for attachment to the hinge leaf, said side sections having at least one aperture therein for use in attaching said U-shaped bracket to the door.

* * * * *